United States Patent [19]

Franks et al.

[11] 4,120,997

[45] Oct. 17, 1978

[54] PROCESS FOR PRODUCING ONE-SIDE GALVANIZED SHEET MATERIAL

[75] Inventors: Lawrence L. Franks, St. John; David W. Gomersall, Valparaiso, both of Ind.

[73] Assignee: Inland Steel Company, Chicago, Ill.

[21] Appl. No.: 685,365

[22] Filed: May 11, 1976

[51] Int. Cl.[2] ..... B05D 3/12

[52] U.S. Cl. ..... 427/367; 204/28; 427/360; 427/368; 427/376 G; 427/376 H; 427/383 D; 427/433

[58] Field of Search ..... 427/271, 277, 360, 367, 427/368, 383 D, 376 G, 376 H, 433, 399; 204/28, 206, 208, 209; 428/659

[56] References Cited

U.S. PATENT DOCUMENTS

| | | | |
|---|---|---|---|
| 2,557,764 | 6/1951 | Renkin | 427/433 |
| 2,824,021 | 2/1958 | Cook et al. | 427/433 |
| 3,056,694 | 10/1962 | Mehler et al. | 427/433 |
| 3,104,993 | 9/1963 | Sievert et al. | 148/6.15 |
| 3,148,081 | 9/1964 | Ross | 427/433 |
| 3,149,928 | 9/1964 | Schrader | 427/433 |
| 3,177,053 | 4/1965 | Lusa | 29/196.5 |
| 3,177,085 | 4/1965 | Adams | 427/433 |
| 3,178,305 | 4/1965 | Ward | 427/360 |
| 3,181,963 | 5/1965 | Cook et al. | 427/433 |
| 3,295,199 | 1/1967 | Schrader | 427/433 |
| 3,323,940 | 6/1967 | Sievert | 427/433 |
| 3,697,399 | 10/1972 | Usui | 204/208 |
| 3,730,758 | 5/1973 | Laidman | 427/156 |
| 3,932,683 | 1/1976 | Rubins et al. | 427/433 |

*Primary Examiner*—Ronald H. Smith
*Assistant Examiner*—Sadie L. Childs
*Attorney, Agent, or Firm*—Merriam, Marshall & Bicknell

[57] ABSTRACT

A method of continuously producing a one-side-only zinc coated ferrous metal strip initially having zinc coated on both wide surfaces, as by differentially hot-dip coating, and with the zinc on one of the wide surfaces being in the form of a thin film which is transformed into a thin zinc-iron intermetallic layer by applying heat to only the wide surface of the strip having the zinc in the form of a thin film and abrading the surface of the intermetallic layer thus formed by brushing to effect complete removal thereof, leaving the other wide surface of the strip coated with zinc.

10 Claims, 1 Drawing Figure

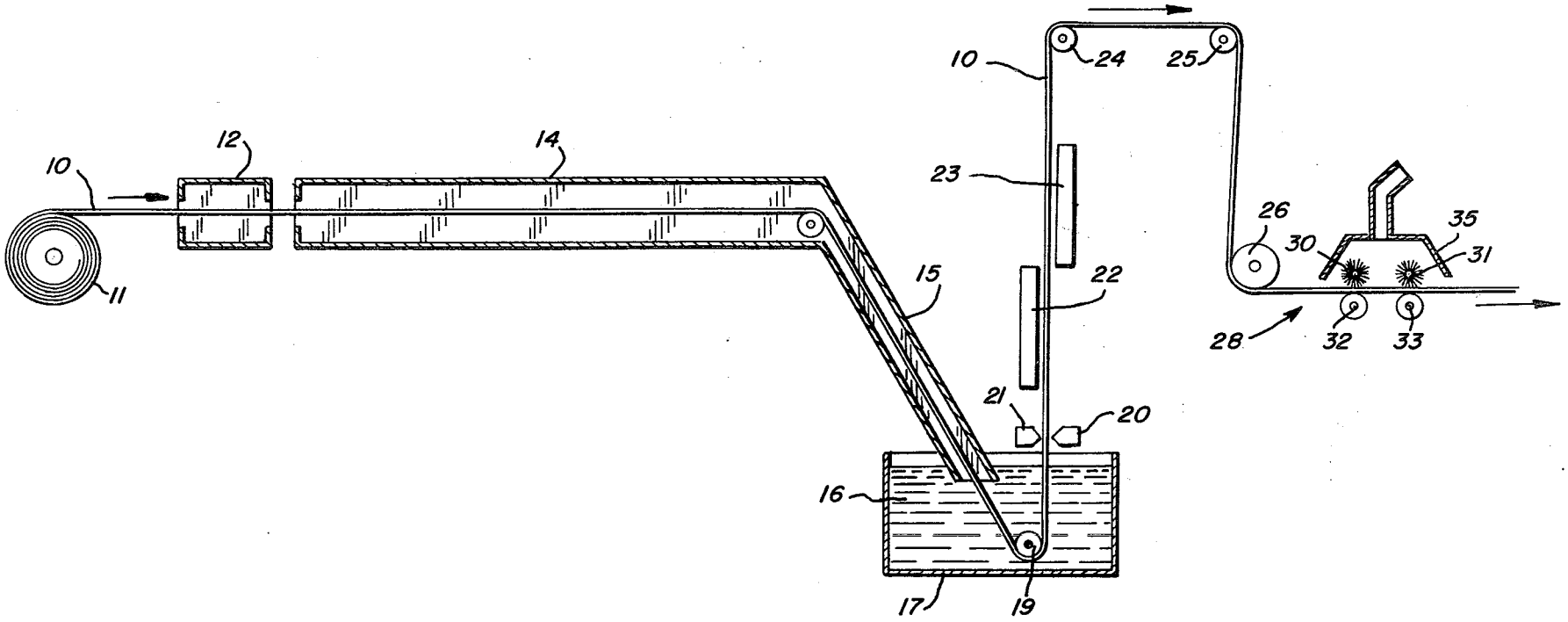
10
11
12
14
15
16
17
19
20
21
22
23
24
25
26
28
30
31
32
33
35

PROCESS FOR PRODUCING ONE-SIDE GALVANIZED SHEET MATERIAL

The present invention relates generally to a method of zinc coating a ferrous metal, and more particularly to a method of continuously galvanizing a ferrous metal strip or sheet on one-side-only.

Galvanized sheet metal is conventionally used in many applications where the metal is exposed to corrosive atmospheres and other corrosive conditions. One important use for corrosion resistant galvanized material is in the manufacture of automotive bodies. One-side-only galvanized sheet material is particularly desirable for use where one surface must be painted and the other is exposed to conditions which promote rusting. The conventional galvanized sheet material which is coated on both sides with zinc has not been widely accepted for automobile body panels, for example, because of the relatively poor exterior finish which results when a galvanized surface is enameled or painted. It would therefore be highly desirable to provide an inexpensive galvanized sheet material which is zinc coated on one-side-only, leaving the other side uncoated and suitable for receiving an enamel finish coating.

Heretofore, several methods for producing ferrous metal sheet material having a galvanized coating on one-side-only have been proposed wherein a barrier coating is applied to one surface of a ferrous metal sheet or strip (see Adams U.S. Pat. No. 3,177,085 and Sievert U.S. Pat. No. 3,104,933) before immersing the sheet in a hot-dip galvanizing bath and thereafter removing the barrier coating. A process for producing one-side-only galvanized sheet material has also been disclosed wherein one side of a steel strip is kept out of contact with an electrolyte bath while the opposite side is electrogalvanized (see U.S. Pat. No. 3,483,098). Also, a process for removing a thin zinc coating from one side of a differentially hot-dip coated steel strip by chemical or electrolytic means has been disclosed in U.S. Pat. No. 3,178,305.

Since one of the principal commercial methods for the continuous production of galvanized sheet material (i.e. the heat treat in-line continuous hot-dip galvanizing process) requires continuously passing an endless strip of the sheet material through a galvanizing line in which the strip is heated to an elevated temperature in a reducing atmosphere to remove oxides from the free metal surface immediately prior to hot-dip galvanizing, it is essential that any zinc barrier coating applied to the strip be highly stable and adherent under the foregoing heating conditions. The known barrier coatings, however, under some conditions lose their ability to adhere securely to a ferrous metal surface when heated in a reducing atmosphere at elevated temperatures and permit zinc to be deposited on the "uncoated" side of the strip. Furthermore, the electrolytic and chemical methods are quite expensive to operate and require special equipment not generally used in a conventional continuous hot-dip galvanizing line. Consequently, the known methods for producing one-side-only galvanized sheet material are not entirely satisfactory for use in large scale continuous galvanizing operations.

It is therefore an object of the present invention to provide a simpler and more efficient method of continuously producing a ferrous metal sheet material galvanizing on one-side-only.

It is also an object of the present invention to provide a method of galvanizing ferrous metal sheets on one-side-only which can be used in conjunction with a conventional Sendzimir type continuous galvanizing line without requiring extensive changes in equipment or operating conditions.

It is a further object of the present invention to provide a method of producing a one-side-only galvanized ferrous metal sheet in which the zinc coating on a ferrous metal sheet initially zinc coated on both sides is readily removed from only one side of the ferrous metal sheet without employing electrolytic or chemical means.

Other objects will be readily apparent to those skilled in the art from the detailed description and claims to follow when read in conjunction with the accompanying drawing FIGURE.

It has been discovered that instead of a diffusion bond forming between the surface of a ferrous metal and a thin zinc coating which is tightly adherent to the surface of the ferrous metal sheet so that the removal thereof is difficult, as would be expected, when a very thin uniform zinc film or metallic zinc coating is formed directly on the smooth surface of a ferrous metal sheet and thereafter completely converted by controlled heating into a zinc-iron intermetallic layer, the thin intermetallic layer formed is so brittle that it can be readily fractured and completely removed by applying a mild mechanical abrading force to the surface of the zinc-iron intermetallic layer, leaving the one side of the strip completely free of zinc and in condition for satisfactorily painting, enameling or welding while the protective zinc coating on the opposite side of the sheet remains unimpaired and in its as-coated condition.

In achieving the objects of the present invention a clean elongated ferrous metal sheet or strip, such as an endless steel strip suitable for continuous galvanizing, is preferably first provided with a zinc coating on both surfaces, as by hot-dip coating, so that the strip has a thin coating or film of zinc on at least one side of the strip with the thin zinc coating or film having a coating weight such that it can be rapidly and completely converted by moderate heating into a uniform thin zinc-iron intermetallic layer which can be readily removed from the surface of the strip by applying a mild mechanical surface abrading force to the intermetallic layer.

In the preferred embodiment of the invention the strip is differentially hot-dip coated so as to provide a protective zinc coating on one side having a thickness sufficient to impart the required degree of protection against corrosion and having on the other side the uniform thin zinc film or coating. Thereafter, and preferably before the coating solidifies, the side of the strip which has the thin zinc film thereon is exposed to a gas burner or other suitable source of heat which applies heat to only the thin zinc coated side of the strip and cause the thin zinc coating or film to be completely converted into a uniform zinc-iron intermetallic layer. The thin zinc-iron intermetallic layer thus formed is thereafter subjected to mechanical brushing or otherwise abraded to effect the complete removal of the intermetallic layer from the surface of the strip, leaving a clean ferrous metal surface on one side of the strip and a protective zinc coating on the opposite side of the strip.

In order to insure the rapid complete conversion of the zinc coating or film into a zinc-iron intermetallic layer and the complete removal of the thin zinc-iron intermetallic layer, it is desirable that the uniform zinc coating or film provided on one surface of the strip have as little zinc as possible remaining on the surface of the one side, and preferably the zinc film should not be more than about 0.10 mil thick and most preferably only about 0.05 mil thick. The protective zinc coating on the opposite side of the strip can be of any desired thickness but usually has a substantially greater thickness than the zinc film which is removed. Where the ferrous metal strip itself is thin the opposite or heavier zinc coated side of the strip can be cooled, preferably immediately after the thin zinc coating is heated to form the intermetallic layer. By rapidly cooling the opposite heavier zinc coated side of the strip, the formation of a thick subsurface zinc-iron intermetallic layer between the ferrous metal base and the protective zinc coating is minimized, thereby maintaining good formability properties in the one-side zinc coated product.

In the preferred hot-dip coating method of providing the ultra-thin zinc coating or film on at least one side of the ferrous metal strip, the hot-dip galvanizing bath can have any composition suitable for continuous hot-dip coating an endless steel strip. The coating bath temperature is preferably maintained slightly above the normal 850° F bath temperature, and preferably at about 900° F, to accelerate the complete conversion of the thin zinc coating into the desired zinc-iron intermetallic layer.

In hot-dip coating the ferrous metal strip it has been found desirable to effect removal of the excess zinc coating material to provide the ultra-thin coating or film of zinc on one side by impinging gas jets onto the one side of the hot-dip coated strip as it is withdrawn from the coating bath, since it is not presently practical to obtain the desired ultra-thin hot-dip zinc coating or film by means of conventional coating-weight control rolls. It will be understood, of course, that the thickness of the zinc coating on the opposite surface of the strip can also be controlled by gas impingement jets. Suitable apparatus and methods of controlling the coating weight on one or both sides of the strip are shown in the Robins and Bugajski U.S. Pat. No. 3,932,683 and patents cited therein.

A convenient means for rapidly and completely converting the thin zinc coating or film on one surface of the strip into the desired zinc-iron intermetallic layer which is capable of being readily removed by application of a mechanical abrasion force is to expose only the thin zinc coated side of the strip, preferably immediately after removal of excess zinc and before the thin coating solidifies, to a gas burner or other source of heat which is capable of heating the thin zinc coating to a temperature sufficient to cause the zinc coating to form a uniform zinc-iron intermetallic layer having an average iron content of between about 4 and 20 wt. %, and preferably about 7–12 wt. % while avoiding heating significantly the opposite surface of the strip. Once the intermetallic layer has been formed on the thin zinc side of the strip further heating of the strip should be avoided to prevent forming an objectionably thick subsurface intermetallic layer on the opposite or heavy zinc coated side of the strip which would significantly decrease the formability of the heavy zinc coating.

The temperature to which the thin zinc coated side is heated in order to obtain the conversion of the thin zinc coating or film into the desired intermetallic layer depends inversely on the time the strip is heated (i.e., a relatively low temperature requires a relatively long time and vice versa). Because of the speed with which the strip moves through the typical modern continuous galvanizing line, it is difficult to measure with a high degree of accuracy the temperature which the strip reaches in the heat-treating zone. However, since the thin zinc film preferably is kept molten to speed the formation of the intermetallic layer, the lowest strip temperature at which the strip should be maintained is one somewhat above the melting point of the zinc coating bath which for a conventional continuous hot-dip coating bath composition is in the vicinity of about 850° F. Within the preferred operating temperature range of between about 900° F and about 1500° F, and at the most preferred operating temperature of about 1000° F, the heating times are on the order of about 8 to 10 seconds which permits using line speeds of about 150–170 feet per minute and well within the limits for economical operation of most modern galvanizing lines.

The type of furnace used in heating the thin zinc coated surface is not critical to the successful operation of the process. Thus, any conventional furnace adaptable for use in the continuous heat-treatment of an endless metal strip can be used. Any convenient method of heating the furnace can also be used, such as by burning liquid or gaseous fuels fired either directly into the furnace or in radiant tubes, or by induction heating. A suitable furnace for use with gaseous or liquid fuels comprises a simple open box-like structure lined with an insulating material directly facing the thin zinc coated side of the moving strip. Care should be taken to avoid having any heating gas jets disturb the thin molten zinc film or cause localized hot spots. The furnance is preferably positioned in the line as close as possible to the impinging gas jets which control the coating thickness so that the heat-treatment of the strip is initiated before the molten coating has had time to cool and solidify.

A thin zinc-iron intermetallic layer of the foregoing type can be readily removed from the ferrous metal strip by applying a suitable abrading force to the surface of the thin intermetallic layer without changing the physical characteristics of the ferrous metal strip or the protective zinc coating remaining on the other surface of the strip. Thus, the thin intermetallic layer can be removed by applying an abrading force by any suitable means, including brushes, abrasive pads, sand blasting, or grit blasting. The brushes and abrasive pads can be of any type provided the surface of the strip is not irreparably damaged thereby during the abrading process. The bristles of the brush and the abrasive pad can be formed of steel or brass wire, for example. The bristles or fibers of the brush and the pad also can be formed of nylon or other synthetic fiber material. The bristles and fibers of the brush or the pad can be coated or impregnated with an abrasive material, if desired. The abrading force can be applied while the surface of the strip and the abrasive means are dry or when wet, as in a liquid spray, or while immersed in an aqueous bath. Where the abrasive force is applied to the intermetallic layer while the strip and abrasive means are dry, care should be taken to provide means for collecting any fine particles of the intermetallic zinc-iron compounds which are removed from the strip to avoid contaminating the ambient atmosphere and creating a hazardous health condition.

The thin zinc-iron intermetallic layer can be removed from the surface of the strip at any time after the alloying thereof. Thus, removal of the zinc intermetallic layer can be deferred until immediately before the strip is used, if desired. Generally, however, it is more convenient to remove the zinc-iron intermetallic layer immediately after the thin zinc film is converted into the intermetallic layer, preferably in-line immediately after the strip has been cooled to ambient temperature.

A preferred embodiment of the process of the present invention can be carried out by means of apparatus set forth schematically in the accompanying drawing. As illustrated in the drawing FIGURE, a mild steel strip 10 which has a thickness of 0.050 inches and a width of 48 inches is fed from a coil 11 and passed through an oxidizing furnace 12 in which the strip 10 is heated under oxidizing conditions to form a thin uniform oxide coating thereon. The mild steel strip prior to coating should have at least on the side to be light zinc coated a relatively smooth surface profile in order to facilitate removal of zinc on the light side. A typical profile would have an arithmetic average peak height of 40 micro inches and a peak density of 100–120 peaks per inch. The strip traveling at a line speed of 150–170 ft. per minute is passed through a furnace 14 containing a reducing atmosphere in which the oxide coating is reduced to a tightly adhering layer of ferrous metal free of oxides and other impurities. A hood and spout 15 leads from the reducing furnace 14 to a point below the surface of the molten zinc hot-dip coating bath 16 which has a temperature of 900° F. The coating bath 16 in the pot 17 contains about 0.17 wt. % aluminum and 0.09 wt. % lead with the balance essentially zinc. The strip 10 having a temperature of about 900° F – 950° F on entering the bath 16 then passes through the coating pot 17 around a sinker rool 18 and vertically upwardly out of the coating pot 17 between nozzles 20, 21 with each nozzle individually adjusted to blow jets of steam at a temperature of about 350° F, onto the opposite surfaces of the strip so as to provide a uniform thin film or coating of zinc on the light side of the strip having a thickness of 0.04 – 0.05 mil and a heavier zinc coating having a thickness of 0.45 – 0.50 mil on the heavy zinc coated side of the strip 10. The strip 10 then moves vertically upwardly past a heating zone comprising a gas fired furnace 22 applying a flame having a temperature of 1000° F – 1500° F for a period of about 10 seconds directly to the side of the strip having the very thin zinc film thereon. While the strip moves past the furnace 22 the heat applied is sufficient to completely convert the thin zinc film into a zinc-iron intermetallic layer having an average iron content ranging between 7 and 12 wt. percent. Immediately after the zinc-iron intermetallic layer is formed, the strip is preferably cooled rapidly in a cooling zone 23 by impingement of low temperature steam having a temperature of 300° F onto the heavier zinc coated side to cool the strip rapidly to a temperature below that which will cause significant further increase in the thickness of the intermetallic layer on the heavier coated side of the strip. The strip is then passed over rolls 24, 25 and around a drive roll 26 to an abrading station 28. The abrading station 28 is comprised of a pair of ten-inch diameter cylindrical brushes 30, 31 mounted side-by-side with each of the brushes having backup rolls 32, 33 installed on the opposite side of the strip 10 beneath each of the brushes 30, 31, respectively. The bristles of the brushes 30, 31 formed of synthetic fibers were impregnated with a mixture of silicon carbide and aluminum oxide abrasive particles (i.e., Scotch-Brite®, Type "A" Discs, Fine). The brushes 30, 31 apply a mild abrasive force to the thin zinc-iron intermetallic layer to effect complete removal of the layer, leaving the one surface of the strip completely free of zinc. If desired, the brushes 30, 31 can be formed of high carbon steel wire bristles having a diameter of 0.016 inch. A hood 35 is provided above the brushes 30, 31 to remove particles formed during the brushing operation. Thereafter, the strip passes to a take-up reel (not shown).

In the specific embodiments of the present invention heretofore discussed the thin zinc film or coating which is formed on one of the wide surfaces of a ferrous metal strip and the protective zinc coating formed on the opposite wide surface of the strip have been applied by a hot-dip coating process. It should be understood, however, that the present process can also be used to remove a thin zinc coating or film which has been deposited on a ferrous metal strip in ways other than by hot-dip coating. For example, while a protective zinc coating can be electrolytically applied to one surface of a steel strip, frequently a thin zinc coating is inadvertently formed along at least the edges of the strip even when a deliberate effort is made to electrolytically coat only one surface of the strip (i.e. the "wrap-around" effect). The present process is adapted to remove the latter thin zinc film electrolytically deposited along the edge portions of an electrolytically one-side coated ferrous metal strip.

Where reference is made in the specification and claims to a zinc coating or a zinc coating bath it should be understood that the term "zinc" includes not only the convention metallic zinc coating and conventional galvanizing bath but also zinc alloy coating and baths containing one or more metals, such as aluminum, lead, antimony, and magnesium or any metal which can be used in a zinc based protective coating or in zinc hot-dip coating baths.

We claim:

1. A process of making a one-side-only zinc coated ferrous metal strip comprising; continuously moving an endless ferrous metal strip through a zinc coating means which provides on one of the surfaces thereof a metallic zinc coating having a thickness which is adapted to protect the surface against corrosion while providing on the other surface of the said strip an ultra-thin metallic zinc film, moving said coated strip continuously through a heat treating zone in which heat is applied directly to only said ultra-thin metallic zinc film, heating said ultra-thin metallic zinc film in said heating zone until all of the zinc in said film is converted into a zinc-iron intermetallic surface film and discontinuing heating thereof before any significant increase in thickness occurs in the zinc-iron alloy intermetallic sub-surface layer associated with the said zinc coating, and removing completely the said zinc-iron intermetallic surface film from the surface of said strip by applying an abrading force thereto.

2. A process as in claim 1, wherein said thin zinc film has a maximum thickness of about 0.10 mil.

3. A process as in claim 1, wherein said zinc-iron intermetallic layer has an average iron content of between about 4 and 20 wt. percent.

4. A process as in claim 3, wherein said intermetallic layer has an average iron content of about 7 to 12 wt. percent.

5. A process as in claim 1, wherein said zinc coating and the thin film of zinc are formed by a continuous differential hot-dip coating process.

6. A process as in claim 1, wherein said zinc coating and thin film of zinc are formed by an electrolytic zinc plating process.

7. A process as in claim 1, wherein said ultra-thin metallic zinc film is heated in said heat treating zone before the said film solidifies.

8. A process as in claim 1, wherein said ultra-thin metallic zinc film has a thickness of about 0.04 to 0.05 mils.

9. A process as in claim 1, wherein the thickness of said ultra-thin metallic zinc film is controlled by impingement gas jets.

10. A process as in claim 1, wherein said ultra-thin metallic zinc film is composed on a weight basis of about 0.17 percent aluminum, about 0.09 percent lead and the balance being essentially zinc.

* * * * *